US008818251B2

(12) United States Patent
Furuya et al.

(10) Patent No.: US 8,818,251 B2
(45) Date of Patent: Aug. 26, 2014

(54) METHOD OF PRODUCING CLEANING WEB, IMAGE-FORMING DEVICE AND FIXING DEVICE

(75) Inventors: Hiromi Furuya, Zushi (JP); Yuu Miyaguchi, Kurashiki (JP); Yasuhiro Shirotani, Kurashiki (JP); Kouji Sugimoto, Tokyo (JP)

(73) Assignees: Kuraray Co., Ltd., Kurashiki-shi, Okayama (JP); Tachibana Shoten Co., Ltd., Zushi-shi, Kanagawa (JP); McYamasan Polymers Co., Ltd., Chuo-ku, Tokyo (JP)

( * ) Notice: Subject to any disclaimer, the term of this patent is extended or adjusted under 35 U.S.C. 154(b) by 1264 days.

(21) Appl. No.: 12/308,347

(22) PCT Filed: Jun. 11, 2007

(86) PCT No.: PCT/JP2007/061713

§ 371 (c)(1),
(2), (4) Date: Sep. 13, 2011

(87) PCT Pub. No.: WO2007/145161

PCT Pub. Date: Dec. 21, 2007

(65) Prior Publication Data

US 2012/0003020 A1 Jan. 5, 2012

(30) Foreign Application Priority Data

Jun. 12, 2006 (JP) ..... 2006-162157
Apr. 27, 2007 (JP) ..... 2007-118873

(51) Int. Cl.
*G03G 15/20* (2006.01)

(52) U.S. Cl.
USPC ..... 399/327; 442/136

(58) Field of Classification Search
USPC ..... 399/327, 352
See application file for complete search history.

(56) References Cited

U.S. PATENT DOCUMENTS 5,705,447 A * 1/1998 Kubo ..... 442/334

FOREIGN PATENT DOCUMENTS

JP 09319280 A * 12/1997
JP 2002061063 A * 2/2002
JP 2004352845 A * 12/2004

OTHER PUBLICATIONS

JP 2002061063 English translation.*
JP 2004352845 English translation.*
JP 09319280 English translation.*

* cited by examiner

*Primary Examiner* — David Gray
*Assistant Examiner* — Thomas Giampaolo, II
(74) *Attorney, Agent, or Firm* — Flynn, Thiel, Boutell & Tanis, P.C.

(57) ABSTRACT

A cleaning web for cleaning the surface of articles to be cleaned, produced by impregnating a web for cleaning the surface of articles to be cleaned with an oil, wherein the web is a nonwoven fabric containing a melt-liquid-crystal-forming wholly aromatic polyester having a melt viscosity of 20 Pa·s or less at 310° C. as the principal component that is produced by melt-blown method.

6 Claims, 7 Drawing Sheets

METHOD OF PRODUCING CLEANING WEB, IMAGE-FORMING DEVICE AND FIXING DEVICE

TECHNICAL FIELD

The present invention relates to a method of producing a cleaning web for cleaning articles, a cleaning web, and an image-forming device and a fixing device using the same.

BACKGROUND ART

Traditionally known methods of cleaning electrophotographic systems include a method of wiping off the residual toner with a web-like material, a method of brushing off the toner with a brush of pile yarns, a method of scraping off the residual toner with a blade of a rubber material, and a method of removing the toner by feeding a sheet-shaped cleaning material between a pair of rollers, and the like.

However, recently when heat-resistant toners with lower fixing efficiency are used to cope with the end uses that demand heat resistance or when copying is performed at a high speed by using a heat-roller fixing device at a restricted power (quantity of heat), a web cleaning with increased residual toner-removing efficiency is most preferable.

As the raw material for the web, which is important in the web cleaning system, proposed were a nonwoven fabric of an aromatic polyamide resin and a polyethylene terephthalate resin (Patent Document 1), a web formed by thermally bonding a nonwoven fabric of an aramide fiber and an undrawn poly(phenylene sulfide) fiber (Patent Document 2), a web of an aramide fiber and an undrawn polyester fiber (Patent Document 3).

Patent Document 1: Japanese Patent Application Laid-Open No. 58-199371

Patent Document 2: Japanese Patent Application Laid-Open No. 61-289162

Patent Document 3: Japanese Patent Application Laid-Open No. 5-119688

DISCLOSURE OF THE INVENTION

Problems to be Solved by the Invention

Thermal bonding of a mixture of an aramide fiber and an undrawn poly(phenylene sulfide) fiber is practically undesirable, considering that the poly(phenylene sulfide) fiber is very expensive as an industrial raw material.

The web produced by the thermal bonding of the dry or wet nonwoven fabric of an aramide fiber and an undrawn polyester fiber would be most favorable, but thermal bonding is often accompanied by fluffing due to the generation of the thermal fusion of the undrawn polyester and breakage of the sheet due to adhesion to the rollers. For that reason, the calendering rate should be kept reduced to an extremely low speed, causing a disadvantage of a drastically low productivity of the web.

The web of an aramide fiber and an undrawn polyester fiber is aimed at preventing fusion of the web to the calendering heat roll and abrasion of the roller in the cleaning region, but the web had a problem that it contained a binder for molding, and was unfavorable in orientation, caused fluffing, had low heat-resistance temperature and low water-absorption, and was less compatible with oils.

An object of the present invention, which solves the problems above, is to provide a method of producing a cleaning web without the use of a binder in production of the web that is superior in smoothness, release efficiency and disorientation, resistant of fluffing, has a high heat-resistance temperature, is superior in low water-absorption and compatible with oils, and has favorable cleaning characteristics, and also, a cleaning web, and an image-forming device and a fixing device using the same.

Means for Solving the Problems

To solve the above problems and achieve the object, the present invention has the following aspects:

The invention (1) is:

a method of producing a cleaning web, characterized by impregnating a web for cleaning the surface of articles to be cleaned with an oil, wherein the web is a nonwoven fabric containing a melt-liquid-crystal-forming a wholly aromatic polyester having a melt viscosity of 20 Pa·s or less at 310° C. as the principal component that is produced by the melt-blown method and has an average fiber diameter of from 3 to 15 μm, a thickness of 20 to 80 μm, an average basis weight of from 9 to 30 g/m$^2$, a density of from 0.25 to 1.4 g/cm$^3$, a maximum tensile stress in the machine and crosswise directions of from 1.0 to 4.0(N/1.5 cm), and an elongation in the machine and crosswise directions of approximately 3%.

The invention (2) is:

the method of producing a cleaning web according to (1), wherein the thermal deformation temperature of the web is 280° C. or higher.

The invention (3) is:

the method of producing a cleaning web according to) (1) or (2), wherein the nonwoven fabric is impregnated with the oil from the side heated under pressure when the nonwoven fabric is previously conveyed through the space between a metal roll and an elastomer roll as heated under pressure.

The invention (4) is:

a cleaning web characterized by being produced by impregnating a web for cleaning the surface of articles to be cleaned with an oil, wherein the web is a nonwoven fabric containing a melt-liquid-crystal-forming wholly aromatic polyester having a melt viscosity of 20 Pa·s or less at 310° C. as the principal component that is produced by melt-blown method and has an average fiber diameter of from 3 to 15 μm, a thickness of from 20 to 80 μm, an average basis weight of from 9 to 30 g/m$^2$, a density of from 0.25 to 1.4 g/cm$^3$, a maximum tensile stress in the machine and crosswise directions of from 1.0 to 4.0 (N/1.5 cm), and an elongation in the machine and crosswise directions of approximately 3%.

The invention (5) is:

the cleaning web according to (4), wherein the thermal deformation temperature of the cleaning web is 280° C. or higher.

The invention (6) is:

the cleaning web according to (4) or (5), wherein the nonwoven fabric is impregnated with the oil from the side heated under pressure when the nonwoven fabric is previously conveyed through the space between a metal roll and an elastomer roll as heated under pressure.

The invention of (7) is:

an image-forming device for forming a latent image on an image carrier, developing the latent image into a toner image, and transferring the toner image on printing paper, characterized in that the surface of the image carrier is cleaned with the cleaning web according to any one of (4) to (6).

The invention of (8) is:

a fixing device for fixing a toner image on a recording medium by heat and pressure while the recording medium carrying an unfixed toner image is fed between the fixing roller and the pressure roller, characterized in that the surface of the fixing roller is cleaned with the cleaning web according to any one of (4) to (6).

Effect of the Invention

In the configuration above, the present invention has the following advantageous effects.

In the inventions described in (1) and (4), produced is a cleaning web containing a melt-liquid-crystal-forming wholly aromatic polyester having a melt viscosity of 20 Pa·s or less at 310° C. as the principal component that is produced by a melt-blown method without the use of a binder and that is superior in smoothness, release efficiency, disorientation, resistant of fluffing, has a high heat-resistance temperature, superior in low water-absorption and more compatible with oils, made of ultrafine fibers, has a smaller difference in tensile strength between in the machine and crosswise directions and a smaller elongation, stabilized, and has desired cleaning characteristics.

In the inventions of (2) and (5), the cleaning web has a thermal deformation temperature of 280° C. or higher and is thus superior in thermal dimensional stability (heat resistance).

In the inventions of (3) and (6), it is possible to prevent filming of the surface of the nonwoven fabric heated and pressurized by the elastomer roll and impregnate the nonwoven fabric with an oil sufficiently from the surface heated and pressurized by the elastomer roll and thus provide desirable cleaning characteristics, by conveying the nonwoven fabric as heated and pressurized between the metal roll and the elastomer roll.

In the invention described in (7), it is possible to obtain desirable cleaning characteristics by cleaning the surface of an image carrier by using the cleaning web described in any one of (4) to (6).

In the invention described in (8), it is possible to obtain favorable cleaning characteristics by cleaning the surface of a fusing roll with the cleaning web according to any one of (4) to (6).

EXPLANATION OF REFERENCE NUMERALS

Figure 1:
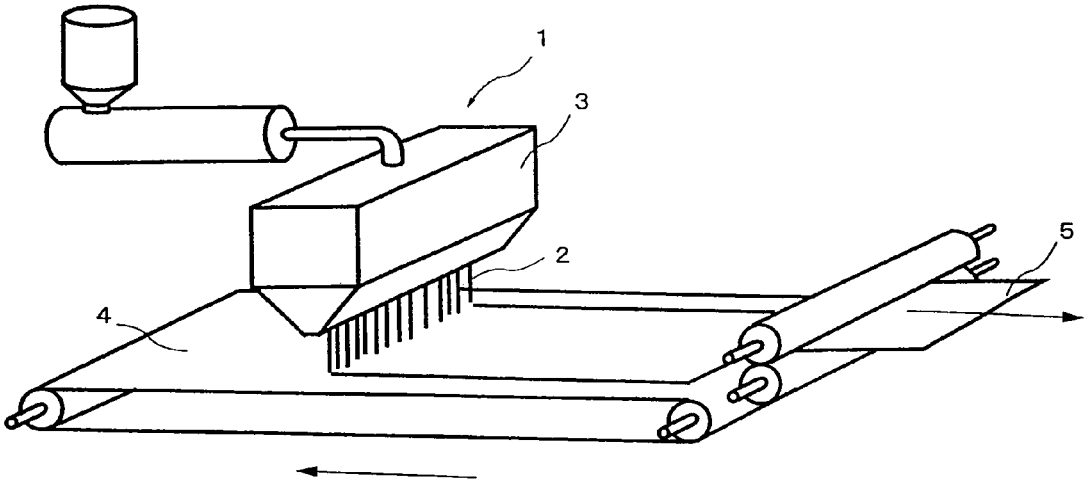
FIG. 1 is a schematic configurational view illustrating a melt-blowing apparatus.

1: Melt-blowing apparatus
2: Wholly aromatic polyester
3: Coating nozzle
4: Mesh
5: Nonwoven fabric
10: Cleaning web-producing machine
11: Oil tank
12: Supply roller
13: Coating roller
14: Transfer roller
15: Feed roll
16: Nonwoven fabric
17: Take-up reel
18: Blade
**19*a***: Metal roll
**19*b***: Rubber roll
20: Image-forming unit
30: Image carrier
31: Image-forming device
32: Printer unit
34: Cleaning unit
36: Transfer unit
60: Cleaning web
61: Feeding roll
62: Cleaning roller
63: Winding roll
80: Monochromic fixing device
81: Monochromic unfixed toner image
82: recording medium
83: Fixing roller
84: Pressure roller
85: Cleaning unit
86: Cleaning web
86: Cleaning web
87: Feeding roll
88: Transfer roller
89: Winding roll
90: Color fixing device
91: Unfixed color toner image
92: Recording medium
93: Fixing roller
94: Pressure roller
95: Cleaning roller

BEST MODE OF CARRYING OUT THE INVENTION

Hereinafter, favorable embodiments of the method of producing a cleaning web, the cleaning web, the image-forming device and the fixing device will be described, but the embodiments of the present invention only show the best mode of carrying out the invention, and it should be understood that the present invention is not restricted thereby.

Hereinafter, the method of producing a cleaning web according to the present invention will be described. Wholly aromatic polyesters have been used as fibers, because they have a high melting point due to their rigid molecular skeletons and are superior in heat resistance and chemical resistance, but it is rather difficult to spin these resins, because they form melt liquid crystal and to produce fibers having a fine denier because they could hardly be drawn.

However, in the present invention, it is possible to solve the problems by using a wholly aromatic polyester having a melt viscosity of 20 Pa·s or less at 310° C. as the melt-liquid-crystal-forming wholly aromatic polyester and thus, to produce a nonwoven fabric of the ultrafine fiber of the melt-liquid-crystal-forming wholly aromatic polyester.

The melt-liquid-crystal-forming wholly aromatic polyester for use in the present invention is not particularly limited, if it has a melt viscosity of 20 Pa·s or less at 310° C., and examples thereof include the condensate of p-hydroxybenzoic acid and 1,6-hydroxynaphthoic and the copolymers thereof, and polyesters having the structural units represented by the following Chemical Formula.

Formula 1

[Formula 1]

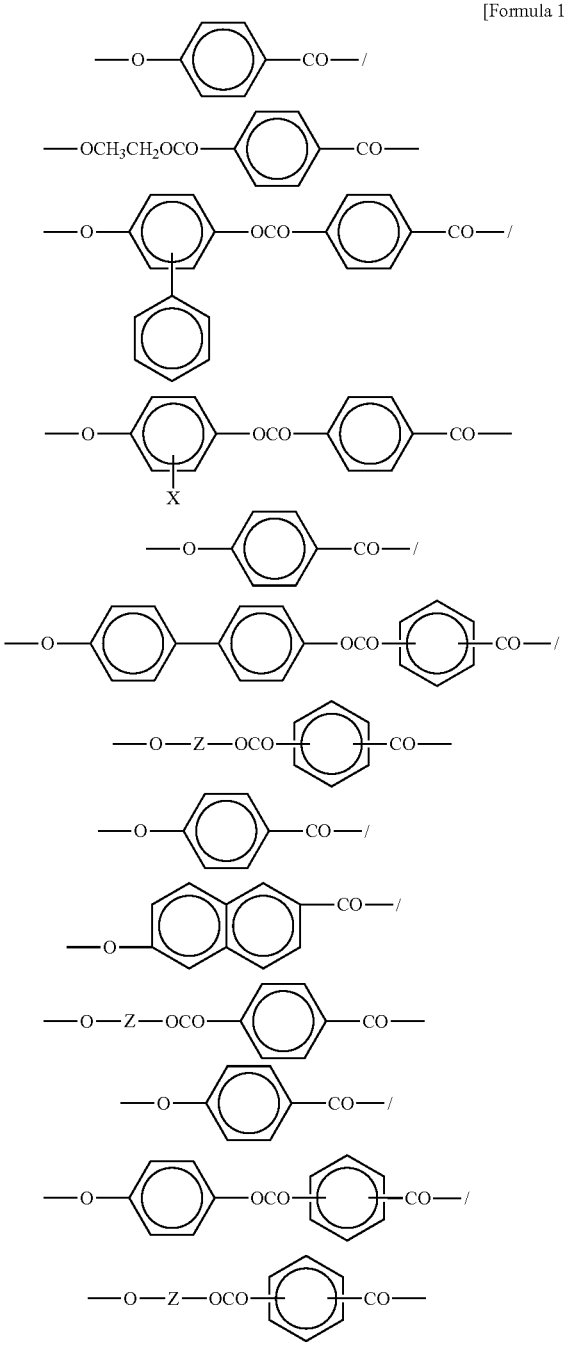

Wholly aromatic polyesters having a melt viscosity at 310° C. of higher than 20 Pa·s are unsuitable for processing to ultrafine fiber and cause troubles such as generation of oligomers during polymerization and granulation during polymerization, and are thus unfavorable. On the other hand, polyesters having an excessively lower melt viscosity are also unsuitable for processing into fiber, and thus, the polyester preferably has a melt viscosity of 5 Pa·s or more at 310° C. When the viscosity is expressed by inherent viscosity, the wholly aromatic polyester for use in the present invention preferably has an inherent viscosity (ηinh) of 6.0 or less, preferably 3.0 to 6.0. Melt-liquid-crystal-forming wholly aromatic polyesters having such a melt viscosity can be produced by traditionally known polymerization methods for wholly aromatic polyesters.

The method of producing a nonwoven fabric according to the present invention (spinning method) may be melt-blown method, and by the melt-blown method, nonwoven fabrics of ultrafine fiber are produced relatively easily without the use of a solvent for spinning, thus minimizing the adverse effect on environment. In producing the web by the melt-blown method, any known melt-blowing apparatus, such as the one shown in FIG. 1, may be used as the spinning apparatus.

A nonwoven fabric 5 is formed and sheeted directly on a mesh 4 by spreading a blown wholly aromatic polyester 2 through coating nozzles 3 thereon.

As for the spinning condition, the spinning temperature is preferably 310° C. to 350° C.; the hot-air temperature (primary air temperature), 310° C. to 370° C.; and the air quantity per 1 m of nozzle length, 10 $Nm^3$ to 50 $Nm^3$. The average fiber diameter of the fiber constituting the nonwoven fabric thus produced should be from 3 to 15 μm, and preferably it is from 3 to 8 μm. A fiber having an average diameter of less than 3 μm, which often generates fibrous dust and makes it difficult to convert it into web, is undesirable, and that having a diameter of more than 15 μm prohibits desired cleaning characteristics. In the present invention, the average fiber diameter is an average of the diameters of 100 filaments as determined by observation of a scanning electron micrograph of the nonwoven fabric.

EXAMPLES

Hereinafter, the present invention will be described specifically with reference to Examples, but it should be understood that the present invention is not restricted thereby by any means.

(Thickness of Web)

The thickness of a web is calculated according to the following Formula:

$$(\text{Thickness})=\pi/4\times([(\text{Diameter after winding})^2-(\text{Diameter before winding})^2]/\text{Winding length})$$

(Melt Viscosity)

The melt viscosity was determined by using Toyoseiki Capilograph type 1B at a temperature of 310° C. and a shear rate r of 1000-1.

(Evaluation of Chemical Resistance)

A fiber was immersed in o-chlorophenol at 30° C. for 24 hours, and the degree of the fiber dissolved is evaluated by visual observation. It is additionally boiled in 1 N aqueous sodium hydroxide solution for 1 hour, and the weight-loss rate is measure. Further, it is immersed in hexafluoroisopropanol at room temperature for 24 hours, and the degree of the fiber dissolved is evaluated by visual observation. In the present invention, the term "substantially insoluble in solvent" means that the fiber is insoluble in o-chlorophenol and the weight-loss rate after boiling in 1 N aqueous sodium hydroxide solution is 10% or less, and it is not soluble in hexafluoroisopropanol even when immersed therein at room temperature for 24 hours.

(Measurement of Thermal Deformation Temperature)

A sample for measurement having a sample length of 20 mm and a sample weight of 1 g was placed in TMA-50 manufactured by Shimadzu Corporation and heated from room temperature gradually at a programmed heating rate 5° C./min, and the temperature where drastic elongation is observed was determined as the thermal deformation temperature. The temperature was defined as the intersection of the tangent line temperature-elongation curb.

Example 1

A liquid-crystal-forming wholly aromatic polyester was dried thoroughly in a low-dew-point air drier, extruded by a twin screw extruder into a melt blown nonwoven fabric-producing apparatus equipped with a nozzle having a width of 1 m and 1,000 holes. The polymer was blown in the melt-blowing apparatus at a single-hole amount of exhalation of 0.3 g/min, a resin temperature of 310° C., a hot-air temperature of 310° C., and a hot-air blowing rate of 20 $Nm^3$, to give a melt blown nonwoven fabric having a thickness of 20 μm, an average basis weight of 9 $g/m^2$, a density of 0.30 $g/m^3$, a maximum tensile stress in the machine and crosswise directions of 1.0, and an elongation in the machine and crosswise directions of approximately 3%. Although soluble in hexafluoroisopropanol within 24 hours, the nonwoven fabric was superior in chemical resistance, because it was not soluble at all in o-chlorophenol and had a weight-loss rate by sodium hydroxide treatment of as low as 0.8%. In addition, the application of hot air at 100° C. through the nonwoven fabric resulted in no change in shape, indicating that the fabric was superior in heat resistance. The thermal deformation temperature thereof was determined to be 210° C.

Comparative Example 1

A melt blown nonwoven fabric was prepared in a similar manner to Example 1, except that the melt viscosity of the liquid-crystal-forming polyester resin at 310° C. was changed to 30 Pa·s (inherent viscosity: 6.3), but unfavorably, there were many shots (resin particles not in the fibrous shape) observed on the web.

Comparative Example 2

A test was performed in a similar manner to Example 1, except that the wholly aromatic polyester was replaced with polyethylene terephthalate (inherent viscosity: 0.59), and the resulting resin was blown at a resin temperature of 295° C., a primary air temperature of 295° C., at a air-blowing rate of 20 $Nm^3$, to give a nonwoven fabric having an average basis weight of 60 $g/m^2$ and an average fiber diameter of 3.8 μm. A test on the heat resistance of the nonwoven fabric showed a shrinkage thereof of as high as 40%, indicating its unfavorable heat resistance. In addition, when immersed in o-chlorophenol, it was dissolved in a short period of time, showing its low chemical resistance.

Example 2

A melt blown nonwoven fabric having a thickness of 50 μm, an average basis weight of 14 $g/m^2$, a density of 0.28 $g/cm^3$, a maximum tensile stress in the machine and crosswise directions of 1.8, and an elongation in the machine and directions of approximately 3% was prepared in a similar manner to Example 1. The nonwoven fabric was superior in chemical resistance and also in heat resistance, similarly to that of Example 1. The chemical resistance of the nonwoven fabric, when evaluated, was favorable; the weight-loss rate by the sodium hydroxide treatment was 0.1% or less; and it was practically insoluble in o-chlorophenol. Although it swelled slightly in hexafluoroisopropanol, the chemical resistance thereof was favorable. Quite favorably, the thermal deformation temperature of the nonwoven fabric was found to be 273° C.

Example 3

A melt blown nonwoven fabric having a thickness of 70 μm, an average basis weight of 22 $g/m^2$, a density of 0.31 $g/cm^3$, a maximum tensile stress in the machine and crosswise directions of 3.1, and an elongation in the machine and crosswise directions of approximately 3% was prepared in a similar manner to Example 1, except that the liquid-crystal-forming polyester was processed at a blowing temperature and a hot-air temperature respectively of 315° C. The thermal deformation temperature of the nonwoven fabric was favorable at 220° C. In addition, the fabric was dissolved in hexafluoroisopropanol mostly within 24 hours but completely insoluble in o-chlorophenol, and the chemical resistance was also favorable, as the weight-loss rate by sodium hydroxide treatment was 1.0%. Further, there was almost no dimensional change after application of hot air at 100° C. through the nonwoven fabric, and the thermal deformation temperature was determined to be 223° C.

Example 4

A melt blown nonwoven fabric having a thickness of 80 μm, an average basis weight of 25 $g/m^2$, a density of 0.31 $g/cm^3$ or more, a maximum tensile stress in the machine and crosswise directions of 3 and an elongation in the machine and crosswise directions of approximately 3% was prepared in a similar manner to Example 1, except that the liquid-crystal-forming polyester was processed at a blowing temperature and a hot-air temperature respectively of 315° C. The thermal deformation temperature of the nonwoven fabric was favorably at 220° C. The fabric was dissolved in hexafluoroisopropanol mostly within 24 hours but completely insoluble in o-chlorophenol, and the chemical resistance was also favorable, as the weight-loss rate by sodium hydroxide treatment was 1.0%. Further, there was almost no dimensional change after application of hot air at 100° C. through the nonwoven fabric, and the thermal deformation temperature was determined to be 223° C.

(Impregnation with Oil)

The web according to the present invention is a nonwoven fabric containing a melt-liquid-crystal-forming wholly aromatic polyester having a melt viscosity of 20 Pa·s or less at 310° C. as the principal component that is produced by the melt-blown method, and that has an average fiber diameter of from 3 to 15 μm, a thickness of from 20 to 80 μm, an average basis weight of 9 to 30 $g/m^2$, a density of 0.25 to 1.4 $g/cm^3$, a maximum tensile stress in the machine and crosswise directions of 1.0 to 4.0(N/1.5 cm), and an elongation in the machine and crosswise directions of approximately 3%.

The tensile strength is the maximum stress when the nonwoven fabric is broken under tension and is expressed by a value of the maximum load divided by the original sectional area of the nonwoven fabric. For example, a nonwoven fabric having a thickness of 70 μm, a maximum tensile stress in the machine direction of 26.0 (N/1.5 cm) and a maximum tensile stress in the crosswise direction of 13.0 (N/1.5 cm) has a maximum tensile stress in the machine and crosswise directions of 2.0. Alternatively, the elongation is the difference in length of the nonwoven fabric between before and after stretching, as expressed by percentage relative to its original length, and the elongation in the machine and crosswise directions is approximately 3%. The cleaning web is a nonwoven fabric impregnated with an oil in an amount of from 6 to 30 g/m$^2$, and a silicone oil is used favorably as the oil.

Figure 2:
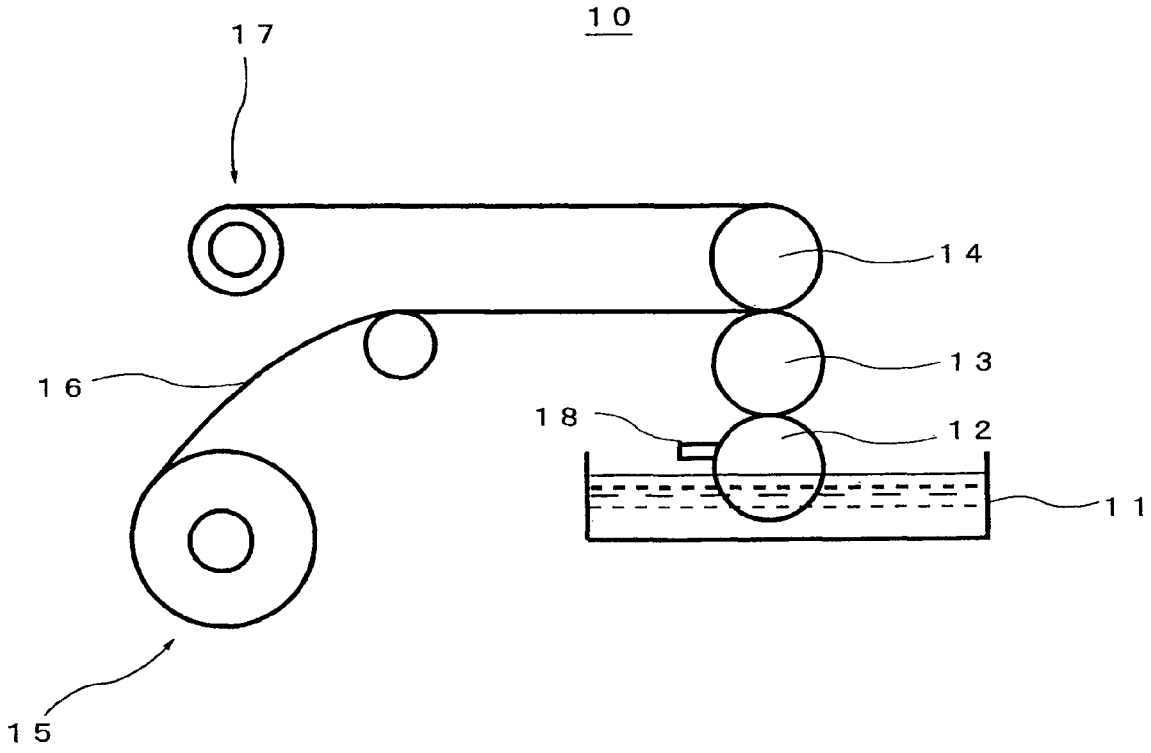
FIG. 2 is a schematic configurational view illustrating a cleaning web-producing machine.

The nonwoven fabric 16 is impregnated with an oil in the cleaning web-producing machine 10 shown in FIG. 2. In the Example, the cleaning web-producing machine 10 has an oil tank 11, a supply roller 12, a coating roller 13 and a transfer roller 14, and a nonwoven fabric 16 fed from a feed roll 15 is impregnated with an oil by the coating roller 13 and wound around a take-up reel 17, giving a cleaning web. The oil is supplied by a blade 18 in contact with the supply roller 12.

In this way, application and impregnation with an oil without the use of a binder in forming the web of the nonwoven fabric 16 gives a cleaning web of a nonwoven fabric containing a melt-liquid-crystal-forming wholly aromatic polyester having a melt viscosity of 20 Pa·s or less at 310° C. as its principal component that was produced by the melt-blown method and that is superior in smoothness, release efficiency and disorientation, resistant of fluffing, has a heat-resistance temperature, superior in low water-absorption and mare compatible with oils, made of ultrafine fibers, has a smaller difference in tensile strength between in the machine and crosswise directions and a smaller stabilized elongation, and having a desired cleaning characteristics.

Figure 3:
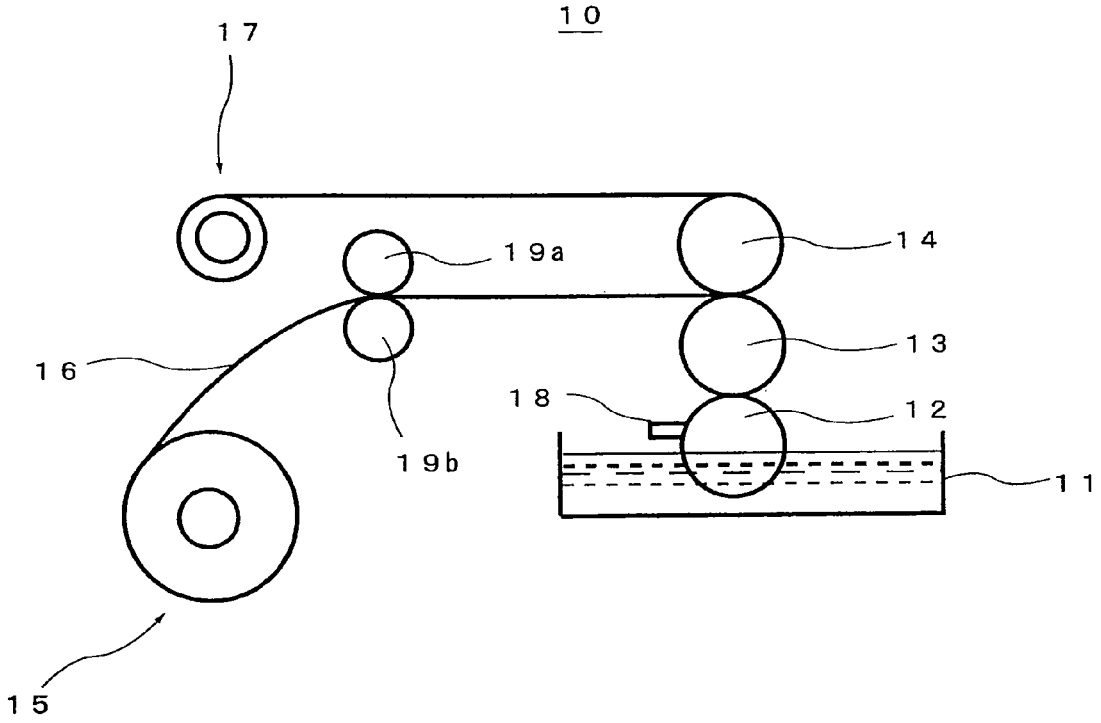
FIG. 3 is a schematic configurational view illustrating another embodiment of the cleaning web-producing machine.
Figure 4:
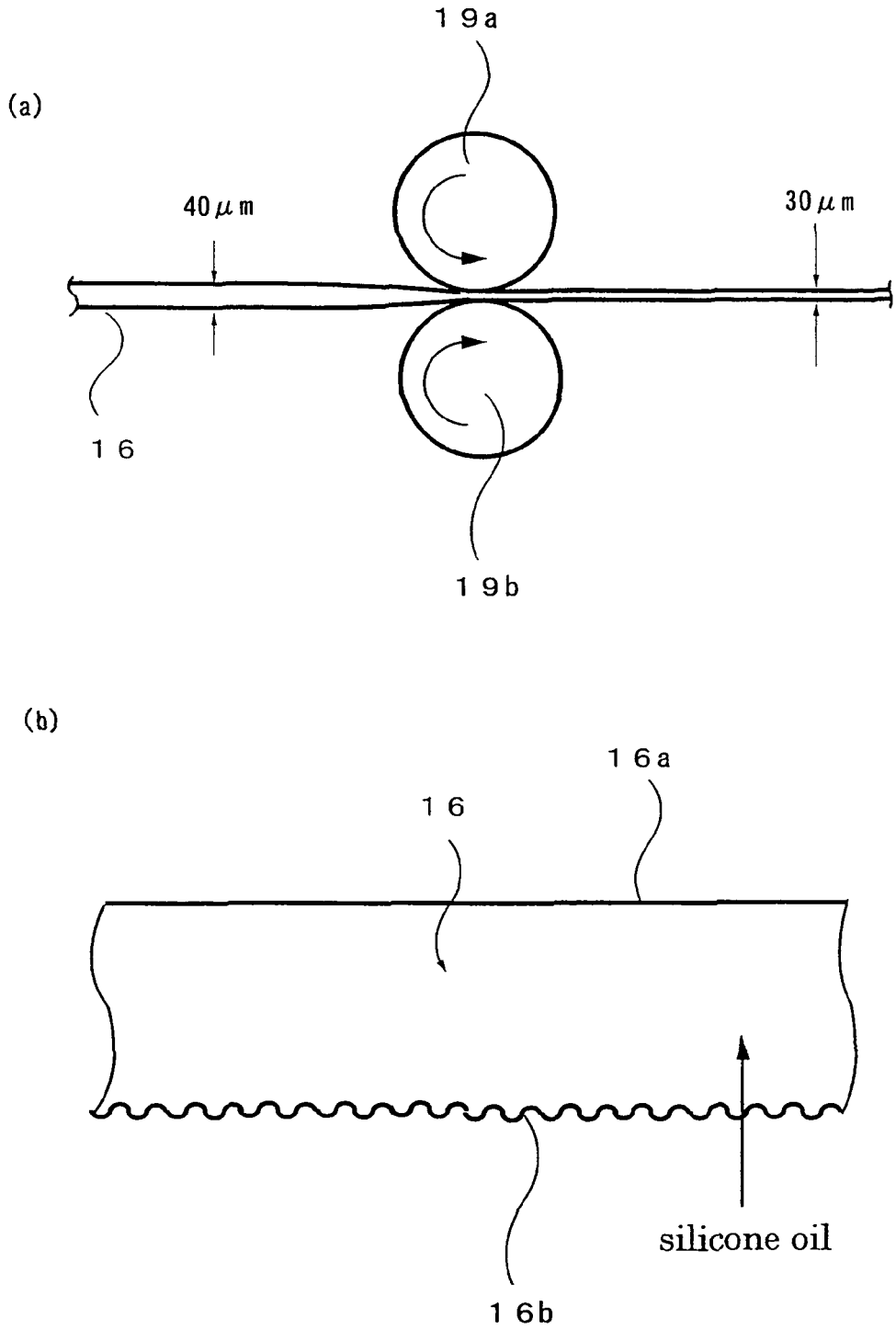
FIG. 4 is a chart showing production of a cleaning web.

As shown in FIGS. 3 and 4, the nonwoven fabric 16 in the Example is conveyed, while it is pressurized and heated between a metal roll 19*a* and an elastomer roll 19*b*. The metal roll 19*a* is, for example, an iron heating roll, while the elastomer roll 19*b* is, for example, a rubber roll. The temperature and the pressure of the metal roll 19*a* during heating are not particularly limited, but are respectively a temperature and a pressure sufficient for making the heated surface 16*a* of the nonwoven fabric 16 in contact with metal roll 19*a* form a film. In addition, the nonwoven fabric 16 preferably has a thickness of from 20 to 80 μm after heating and pressurization between the metal roll 19*a* and the elastomer roll 19*b*. When the nonwoven fabric web 16 contains a melt-liquid-crystal-forming wholly aromatic polyester having a melt viscosity of 20 Pa·s or less at 310° C. as its principal component, the pressurized and heated surface 16*a* of the nonwoven fabric 16 in contact with the metal roll 19*a* forms a film, but the pressurized and heated surface 16*b* of the nonwoven fabric 16 in contact with the elastomer roll 19*b* hardly forms a film. Thus, it is possible to impregnate the web with an oil by the coating roller 13 from the side of the nonwoven fabric 16 pressurized and heated by the elastomer roll 19*b* and to provide the web with favorable cleaning characteristics.

(Image-Forming Device)

Figure 5:
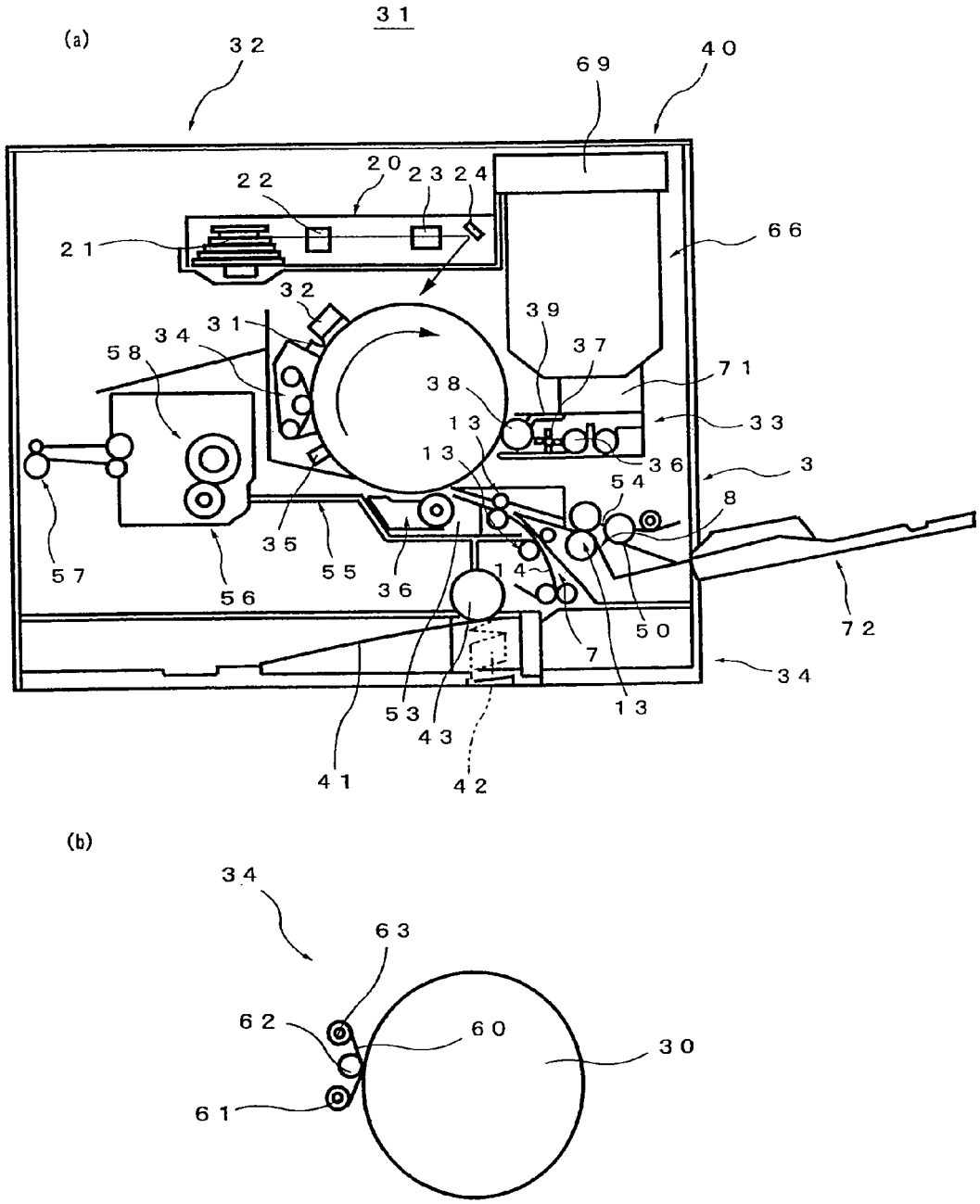
FIG. 5 is a schematic configurational view illustrating an image-forming device.

Hereinafter, an image-forming device for cleaning the surface of an image carrier with the cleaning web will be described. FIG. 5 is a schematic configurational view of an image-forming device. The image-forming device 31, a laser printer, has a printer unit 32 and a recording medium-supplying unit 34 below it, which has multiple automatic feeding cassettes 44, wherein recording media having different sizes are stored. The printer unit 32 has a manual feeding cassette 72 openably and closably installed on the side wall, and the automatic feeding cassette 44 and the manual feeding cassette 72 form feeding and conveying routes 7 and 8 conveying a recording medium to the transfer unit 36.

A bottom plate 41 in the automatic feeding cassette 44 is pushed upward by a spring 42 so that the recording medium therein is pressed to a feeding roller 43, and the feeding roller 43 feeds the recording medium one by one by rotation onto the feeding and conveying route 7. A recording medium placed in the manual feeding cassette 72 is fed one by one onto the feeding and conveying route 8, as it is driven by the feeding roller 50. The feeding and conveying routes 7 and 8 merge with each other before the transfer unit 36, and the recording medium is conveyed into the transfer unit 36 at a particular timing by the conveyor roller pairs 53 and the conveyor guide 54 formed on the feeding and conveying routes 7 and 8.

The transfer unit 36 is located at a position facing an image carrier 30, and an image on the peripheral surface of the image carrier 30 is transferred onto the recording medium collectively. There are a fixing unit 56 and a discharge roller 57 formed on the discharging conveying route 55 of the image-transferred recording medium, and the recording medium discharged from the transfer unit 36 is conveyed to the fixing unit 56. The fixing unit 56 has two crimping rollers 58, at least one of which contains an internal heater, and the medium is pressurized and heated between the two crimping rollers 58, allowing fusion of the deposited toner and fixing of the image on the recording medium, and then, discharged by a discharge roller 57 out of the discharging conveying route 55 of the apparatus.

The printer unit 32 has an image-forming unit 20, and an image is formed on the peripheral surface of the image carrier 30 by irradiation according to image signal by the image-forming unit 20. In the image-forming unit 20, the laser beam emitted from a laser beam source is bent by a polygon mirror 21, sent through a fθ lens 22 and a filter 23 to a reflection mirror 24, where it is also bent and irradiated onto the peripheral surface of the previously charged image carrier 30, forming a latent image on the surface of the image carrier 30.

The image carrier 30 is driven to rotate unidirectionally (clockwise in Figure) and has a PCL 31, a charger 32, a developing device 33, a cleaning unit 34 and a static charge eliminator 35 formed on the periphery of the image carrier 30. After removal of the residual electrostatic charge by previous printing by PCL 31, the image carrier is charged uniformly by the charger 32 on the peripheral surface for the next round of printing. After the uniform charging, an image is irradiated by the image-forming unit 20 according to the image signal.

A developing device 33, which is filled with a developer, a mixture of toner and magnetic carrier, is formed on the peripheral edge of the image carrier 30, and the developing device 33 has an agitating screw 36, a conveyor rotor 37 and a developer carrier 38. The developer is conveyed onto the developer carrier 38 in the shape of layer with a thickness restricted to a particular thickness by a layer-forming rod 39.

An AC bias voltage and a DC bias voltage are applied as convoluted between the image carrier 30 and the developer carrier 38, and the latent image is visualized by a known method. The developing device 33 represents the developing means of visualizing the electrostatic latent image formed on the image carrier 30.

The cleaning unit 34 has a cleaning web 60. The cleaning web 60 is fed from a feeding roll 61 via a cleaning roller 62 to a winding roll 63 where it is wound, and the cleaning web 60 is brought into contact with the image carrier 30 by the cleaning roller 62, while cleaning the surface of the image carrier 30.

The cleaning web 60 is a web of an ultrafine fiber produced without use of a binder during production that is superior in smoothness, release efficiency and disorientation, resistant to fluffing, has a high heat-resistance temperature, and superior low water-absorption and is compatible with oils, and has a smaller difference in tensile strength between in the machine and crosswise directions and a smaller stabilized elongation, and particular cleaning characteristics.

(Fixing Device)

Figure 6:
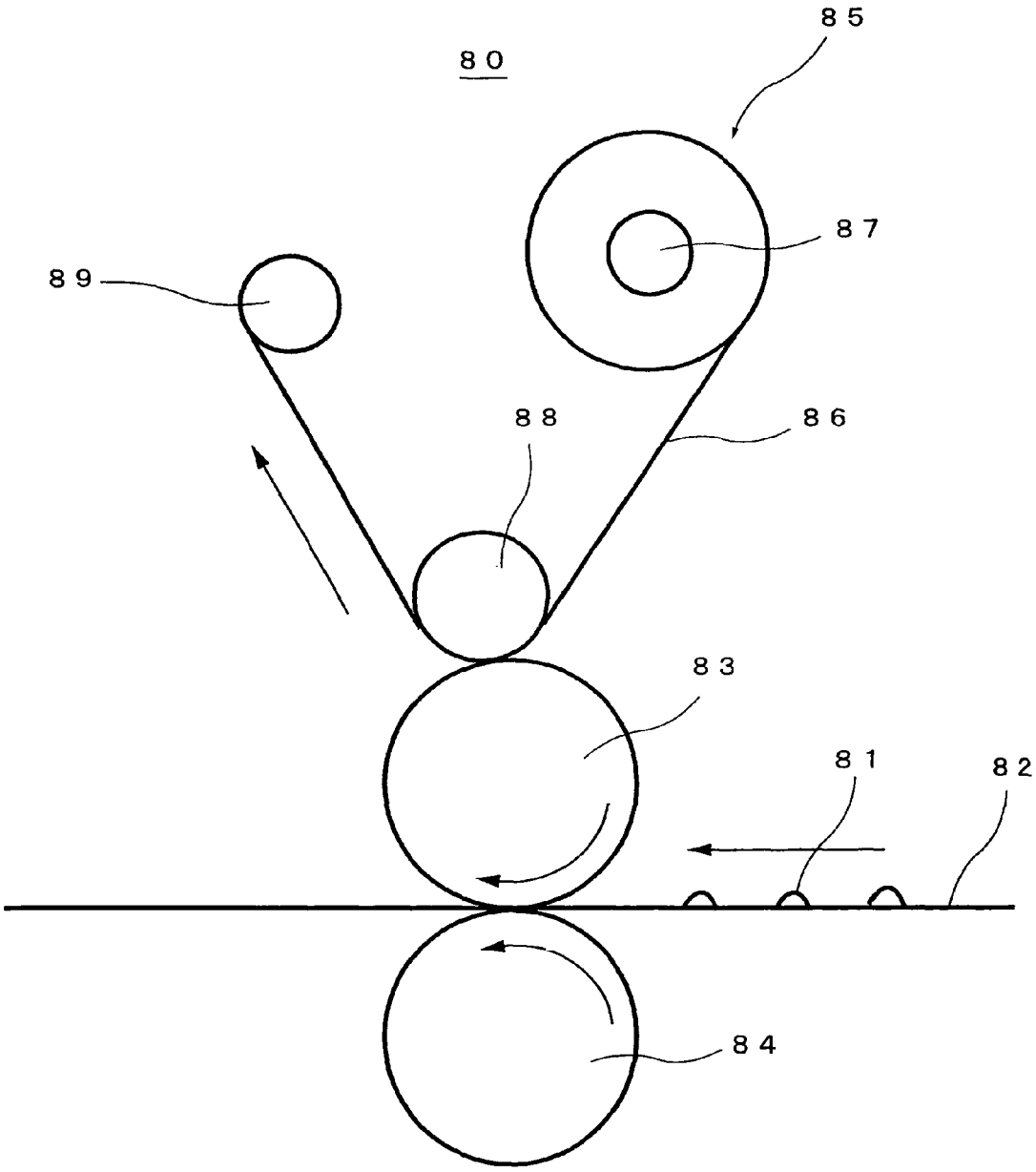
FIG. 6 is a schematic configurational view illustrating an example of monochromic fixing device.

Hereinafter, the fixing device for cleaning the surface of the fixing roller with a cleaning web will be described. FIG. 6 is a schematic configurational view illustrating an example of a monochromic fixing device, and FIG. 7 is a schematic configurational view illustrating an example of a color fixing device.

The monochromic fixing device 80 shown in FIG. 6 fixes the toner image on a recording medium 82 by applying heat and pressure on the recording medium 82 carrying the monochromic unfixed toner image 81 formed, while the recording medium is held between the fixing roller 83 and the pressure roller 84. The fixing device 80 has a cleaning unit 85. The cleaning unit 85 has a cleaning web 86. The cleaning web 86 is fed from a feeding roll 87 via a transfer roller 88 to a winding roll 89 where it is wound, and the cleaning web 86 is brought into contact with the fixing roller 83 by the transfer roller 88, cleaning the surface of the fixing roller 83.

Figure 7:
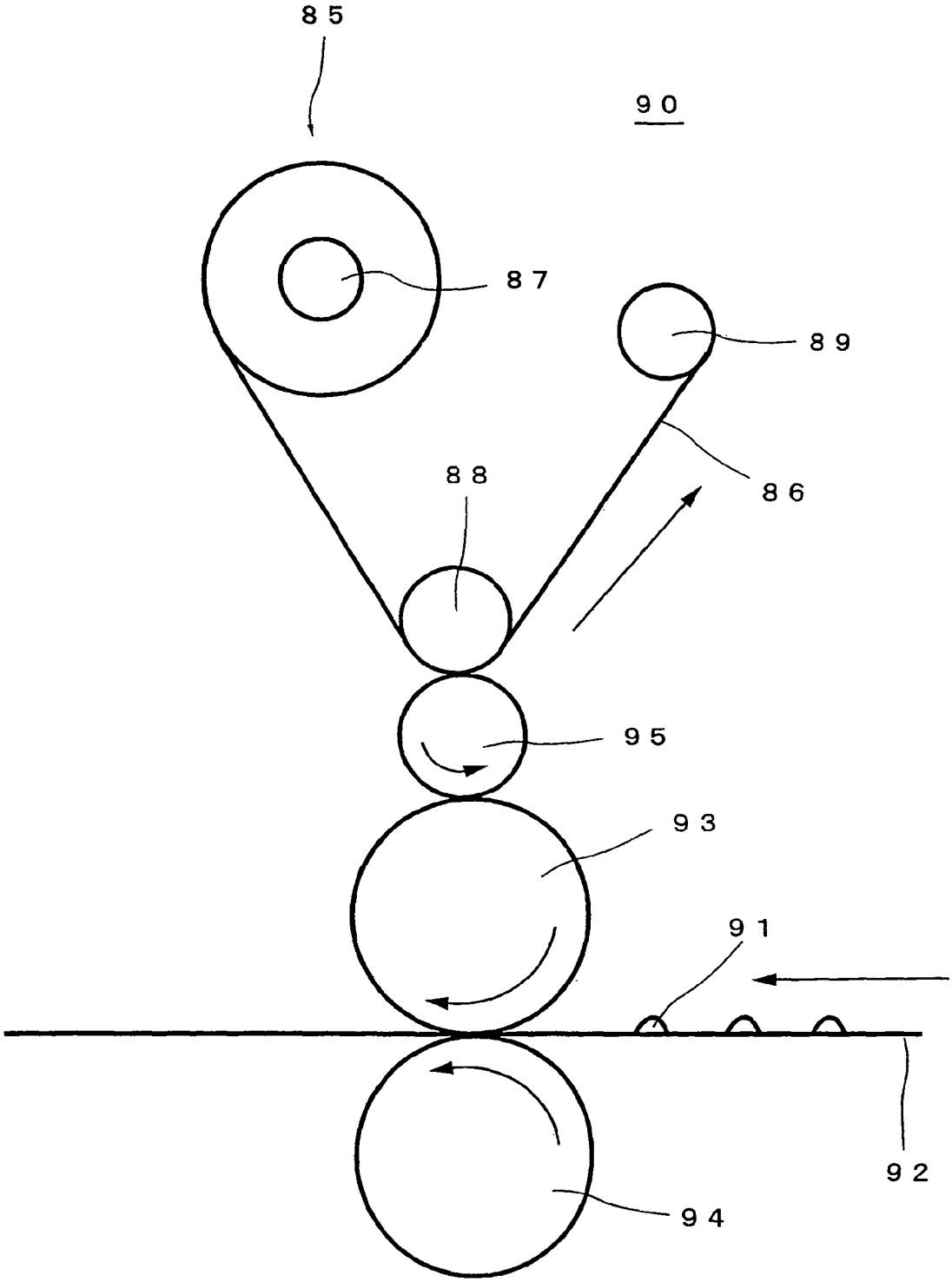
FIG. 7 is a schematic configurational view illustrating an example of color fixing device.

In the color fixing device 90 shown in FIG. 7, a color toner image is fixed on the recording medium 92, as the recording medium 92 carrying the unfixed color toner image 91 formed is heated and pressurized as it is held between the fixing roller 93 and the pressure roller 94. The fixing device 90 has a cleaning unit 85. The cleaning unit 85 has a cleaning web 86; the cleaning unit 8 is configured similarly to the embodiment of FIG. 4; but because many color fixing toners are deposited on the fixing roller 93 in the embodiment, the surface of the fixing roller 93 is first cleaned by the cleaning roller 95. The cleaning web 86 is brought into contact with the cleaning roller 95 by the transfer roller 88, cleaning the surface of the fixing roller 93 indirectly.

The cleaning web 86 is a web of an ultrafine fiber produced without use of a binder during production that is superior in smoothness, release efficiency and disorientation, resistant to fluffing, has a high heat-resistance temperature, superior in low water-absorption and is compatible with oils, has a smaller difference in tensile strength between the machine and crosswise directions, a smaller stabilized elongation, and particular cleaning characteristics.

Hereinafter, evaluation tests of the cleaning web will be described.

Test Condition

A test machine fixing images formed on paper at a rate of 40 sheets/minute was used.

A commercially available woodfree paper for copying was used as the paper, and an image of characters at a density of 6% and a half tone image were formed for evaluation.

Cleaning Web for Evaluation

Comparative Example

A mixture of an aramide fiber and a polyester fiber respectively at 60% and 40% was heated under pressure, to give a cleaning web.

The cleaning web had an average fiber diameter of 15 μm, a thickness of 40 μm, an average basis weight of 20 g/m$^2$, a density of 0.30 g/cm$^3$, a maximum tensile stress in the machine and crosswise directions of 1.8, and an elongation in the machine and crosswise directions of approximately 3%, and was impregnated with a silicone oil in an amount of 12 g/m$^2$.

EXAMPLE

A cleaning web containing a melt-liquid-crystal-forming wholly aromatic polyester having a melt viscosity of 20 Pa·s or less at 310° C. as the principal component was prepared by melt-blown method.

The cleaning web had an average fiber diameter of 10 μm, a thickness of 30 μm, an average basis weight of 11 g/m$^2$, a density of 0.37 g/cm$^3$, a maximum tensile stress in the machine and crosswise directions of 1.8, and an elongation in the machine and crosswise directions of approximately 3%, and was impregnated with a silicone oil in an amount of 12 g/m$^2$.

Evaluation Method

The image formed on the paper was fixed; samples were collected in every 100 sheets of paper; the staining on the releasing blade and on the paper was evaluated by visual observation, both when the cleaning web of Comparative Example and the cleaning web of Example were used, and the results are summarized in Table 1.

Δ: Significant staining

○: Some staining

◎: No staining

TABLE 1

| | Treatment mode | Sheets printed | Feed speed | Staining | 6% Character | FIGURE (half tone) |
|---|---|---|---|---|---|---|
| comparative example | One side | 1000 | 0.7 mm 5 sheets | Staining on releasing blade | ○ | Δ |
| | | | | staining on paper | ◎ | ◎ |
| comparative example | One side | 1000 | 0.7 mm 5 sheets | Staining on releasing blade | Δ | Δ |
| | | | | staining on paper | ○ | ○ |
| example | One side | 1000 | 0.7 mm 5 sheets | Staining on releasing blade | ◎ | ○ |
| | | | | staining on paper | ◎ | ◎ |

TABLE 1-continued

| | Treatment mode | Sheets printed | Feed speed | Staining | 6% Character | FIGURE (half tone) |
|---|---|---|---|---|---|---|
| example | One side | 1000 | 0.7 mm 5 sheets | Staining on releasing blade | ○ | ○ |
| | | | | staining on paper | ◎ | ◎ |

Δ: Significant staining
○: Some staining
◎: No staining

The evaluation test of the cleaning webs showed that the cleaning web of the Example had a higher cleaning efficiency than the cleaning web of the Comparative Example. In addition, the cleaning web of the Example, having a thickness of 30 μm, had a higher cleaning efficiency than the cleaning web Comparative Example, having a thickness of 40 μm, indicating that it was possible to make the cleaning web thinner. It is therefore possible to elongate the length of the cleaning web, while the feed rate of the cleaning web is kept constant, and thus, to elongate the use period of the cleaning web.

INDUSTRIAL APPLICABILITY

The present invention provide a method of producing a cleaning web for cleaning articles to be cleaned and a cleaning web that can be applied to image-forming devices equipped with a fixing device and that is superior in smoothness, release efficiency and disorientation, resistant to fluffing, has a high heat-resistance temperature, is superior in low water-absorption and compatible with oils, and has a smaller difference in tensile strength between the machine and crosswise directions, a smaller stabilized elongation, and particular cleaning characteristics.

What is claimed is:

1. A method of producing a cleaning web characterized by impregnating a web for cleaning the surface of articles to be cleaned with an oil, wherein the web is a nonwoven fabric containing a melt-liquid-crystal-forming wholly aromatic polyester having a melt viscosity of 20 Pa·s or less at 310° C. as the principal component that is produced by melt-blown method and has an average fiber diameter of from 3 to 15 μm, a thickness of from 20 to 80 μm, an average basis weight of from 9 to 30 g/m$^2$, a density of from 0.25 to 1.4 g/cm$^3$, a tensile stress in the vertical and crosswise directions of from 1.0 to 4.0(N/1.5 cm), and an elongation in the vertical and crosswise directions of approximately 3%, wherein the thermal deformation temperature of the web is 280° C. or higher and the nonwoven fabric is impregnated with the oil at an elastomer roll side when the nonwoven fabric is heated under pressure and conveyed through a space between a metal roll and the elastomer roll.

2. The method of claim 1, wherein the melt-liquid-crystal-forming wholly aromatic polyester is a condensate of p-hydroxybenzoic acid and 1,6-hydroxynaphthoic or a copolymer thereof.

3. A cleaning web, characterized by being produced by impregnating a web for cleaning the surface of articles to be cleaned with an oil, wherein the web is a nonwoven fabric containing a melt-liquid-crystal-forming wholly aromatic polyester having a melt viscosity of 20 Pa·s or less at 310° C. as the principal component that is produced by melt-blown method and has an average fiber diameter of from 3 to 15 μm, a thickness of from 20 to 80 μm, an average basis weight of from 9 to 30 g/m$^2$, a density of from 0.25 to 1.4 g/cm$^3$, a maximum tensile stress in the vertical and crosswise directions of from 1.0 to 4.0(N/1.5 cm), and an elongation in the vertical and crosswise directions of approximately 3%, wherein the thermal deformation temperature of the web is 280° C. or higher and the nonwoven fabric is impregnated with the oil at an elastomer roll side when the nonwoven fabric is heated under pressure and conveyed through a space between a metal roll and the elastomer roll.

4. An image-forming device for forming a latent image on an image carrier, developing the latent image into a toner image, and transferring the toner image on printing paper, characterized in that the surface of the image carrier is cleaned with the cleaning web according to claim 3.

5. A fixing device for fixing a toner image on a recording medium by heat and pressure while the recording medium carrying an unfixed toner image is fed between the fixing roller and the pressure roller, characterized in that the surface of the fixing roller is cleaned with the cleaning web according to claim 3.

6. The cleaning web of claim 3, wherein the melt-liquid-crystal-forming wholly aromatic polyester is a condensate of p-hydroxybenzoic acid and 1,6-hydroxynaphthoic or a copolymer thereof.

* * * * *